US011132013B2

(12) United States Patent
Kaiho

(10) Patent No.: US 11,132,013 B2
(45) Date of Patent: Sep. 28, 2021

(54) DEVICE AND SYSTEM

(71) Applicant: Asahi Kasei Microdevices Corporation, Tokyo (JP)

(72) Inventor: Toshio Kaiho, Tokyo (JP)

(73) Assignee: Asahi Kasei Microdevices Corporation, Tokyo (JP)

( * ) Notice: Subject to any disclaimer, the term of this patent is extended or adjusted under 35 U.S.C. 154(b) by 0 days.

(21) Appl. No.: 17/066,505

(22) Filed: Oct. 9, 2020

(65) Prior Publication Data

US 2021/0132648 A1 May 6, 2021

(30) Foreign Application Priority Data

Oct. 31, 2019 (JP) ..... JP2019-199146

(51) Int. Cl.
*G05F 3/24* (2006.01)

(52) U.S. Cl.
CPC ..... *G05F 3/247* (2013.01)

(58) Field of Classification Search
None
See application file for complete search history.

(56) References Cited

U.S. PATENT DOCUMENTS 5,982,205 A * 11/1999 Vallancourt ..... G11C 27/026 327/94
6,313,819 B1 11/2001 Maekawa
6,418,065 B2 * 7/2002 Sato ..... G11C 5/145 327/589
6,587,366 B2 * 7/2003 Tanaka ..... G11C 11/22 365/145
7,535,467 B2 * 5/2009 Kim ..... G09G 3/3688 345/204
8,493,812 B2 * 7/2013 Dengler ..... G11C 5/145 365/230.06
8,698,543 B1 4/2014 Dribinsky
10,050,520 B2 * 8/2018 Tsai ..... H02K 11/20
10,587,189 B1 * 3/2020 Ausseresse ..... H02M 3/073
10,666,245 B2 * 5/2020 Sanchez ..... H02M 3/07
2010/0237931 A1 * 9/2010 Ogiwara ..... G05F 3/30 327/536

FOREIGN PATENT DOCUMENTS

JP H06350432 A 12/1994

* cited by examiner

*Primary Examiner* — Thomas J. Hiltunen

(57) ABSTRACT

Provided is a device connected to a clock and data signal lines, comprising: a voltage input unit configured to be inputted with a clock signal as an input signal from the clock signal line and to generate first reference voltage corresponding to a high level of the clock signal; a reference voltage generation unit configured to be inputted with predetermined input voltage and to generate second reference voltage; a voltage regulation unit for generating regulation voltage by using the second reference voltage to convert a level of the first reference voltage; a drive unit for stepping down the regulation voltage to generate output voltage; a control unit; and an output unit connected with the control unit, the drive unit, and the data signal line, for outputting the output voltage to the data signal line in response to input of a high level of a control signal from the control unit.

15 Claims, 11 Drawing Sheets

DEVICE AND SYSTEM

The contents of the following Japanese patent application are incorporated herein by reference:

NO. 2019-199146 filed in JP on Oct. 31, 2019

BACKGROUND

1. Technical Field

The present invention relates to a device and a system.

2. Related Art

A device connected to a communication bus with a clock signal line and a data signal line has been conventionally known (for example, see Patent document 1).

Patent document 1: U.S. Pat. No. 8,698,543

DESCRIPTION OF EXEMPLARY EMBODIMENTS

Hereinafter, the present invention will be described through the embodiments of the invention, but the following embodiments do not limit the claimed invention. Moreover, not all combinations of features described in the embodiments are essential to solutions of the invention.

Figure 1:
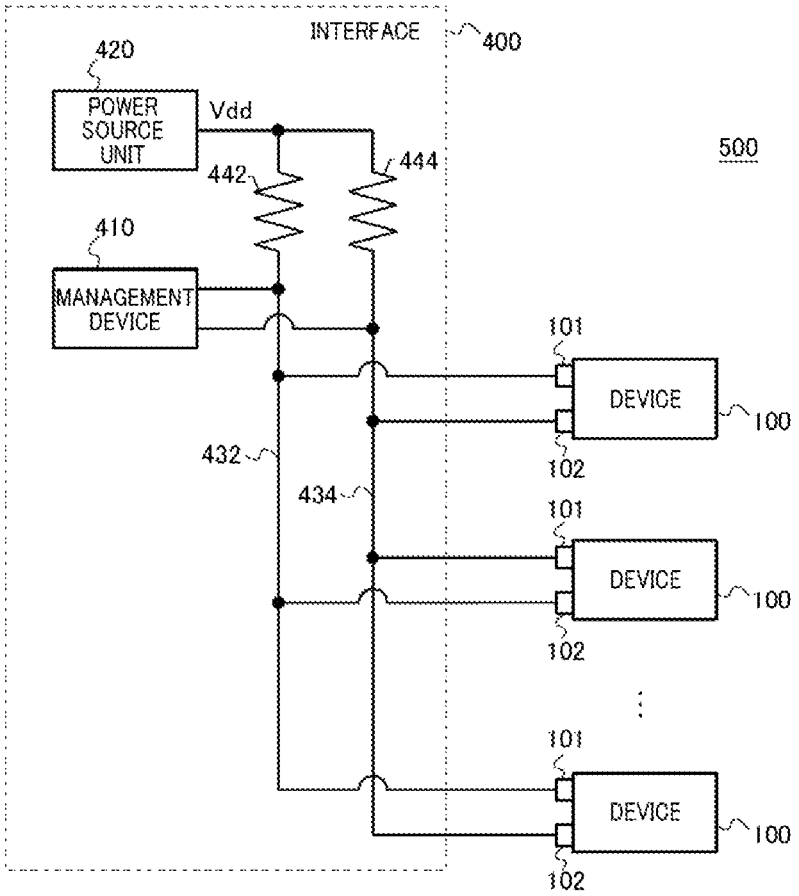
FIG. 1 is a block diagram showing a configuration example of a system 500 according to one embodiment of the present invention.

FIG. 1 is a block diagram showing a configuration example of a system 500 according to one embodiment of the present invention. The system 500 includes an interface 400 and a plurality of devices 100. The system 500 is configured to send/receive data between the interface 400 and the plurality of devices 100.

Note that "between" does not limit a spatial positional relationship. A positional relationship on a circuit may be referred to as "between" herein. For example, that an internal power source generation unit 110 is provided between an input terminal 105 and an output terminal 106 refers to that the internal power source generation unit 110 is arranged to be inputted with a signal directly or indirectly from the input terminal 105, and to output a signal directly or indirectly to the output terminal 106. Inputting/outputting a signal indirectly refers to inputting/outputting a signal through other members. Note that the input terminal 105, the output terminal 106, and the internal power source generation unit 110 will be described later.

The interface 400 includes a management device 410, a power source unit 420, a clock signal line 432, a data signal line 434, a pull-up resistor 442, and a pull-up resistor 444. The management device 410 may include a clock signal generator for generating a clock signal and a data signal generator for generating a data signal. In addition, the management device 410 may include a data signal receiver for receiving a data signal.

The management device 410 is configured to send a clock signal via the clock signal line 432. Moreover, the management device 410 is configured to send/receive a data signal via the data signal line 434. The clock signal line 432 and the data signal line 434 are examples of signal lines for communicating signals in the interface 400. The management device 410 may respectively send a clock signal and a data signal according to a standardized communication system via the clock signal line 432 and the data signal line 434.

The power source unit 420 is configured to apply power source potential Vdd to each of the pull-up resistor 442 and the pull-up resistor 444. The power source potential Vdd is power source potential of a communication bus.

The pull-up resistor 442 is connected between the power source unit 420 and the clock signal line 432, and is configured to set a high level of a clock signal transmitted by the clock signal line 432. The pull-up resistor 444 is connected between the power source unit 420 and the data signal line 434, and is configured to set a high level of a data signal transmitted by the data signal line 434.

The plurality of devices 100 are each connected to the interface 400. In this example, the management device 410 is configured to operate as a master device, and the plurality of devices 100 are configured to operate as slave devices. The plurality of devices 100 in this example are configured to operate in response to a data signal and a clock signal outputted by the management device 410. Each of the plurality of devices 100 includes a clock terminal 101 and a data terminal 102.

Each of the clock terminal 101 and the data terminal 102 is configured to function as an input terminal for inputting a signal to the device 100 or as an output terminal for outputting a signal from the device 100. One terminal may function as both an input terminal and an output terminal. Each of the clock terminal 101 and the data terminal 102 may function as an input/output terminal for inputting/outputting a signal.

The clock terminal 101 in this example is connected to the clock signal line 432, and is configured to be inputted with a clock signal. That is, the clock terminal 101 in this example is configured to function as an input terminal. The data terminal 102 in this example is connected to the data signal line 434, and is configured to be inputted with a data signal from the data signal line 434 and to output a data signal to the data signal line 434. That is, the data terminal 102 functions as both an input terminal and an output terminal.

In an example, the device 100 is configured to sample a data value of an inputted data signal in response to an inputted clock signal. The device 100 may operate based on the data value of the data signal. The device 100 may output, in synchronization with the clock signal, output data corresponding to the operation result.

Figure 2A:
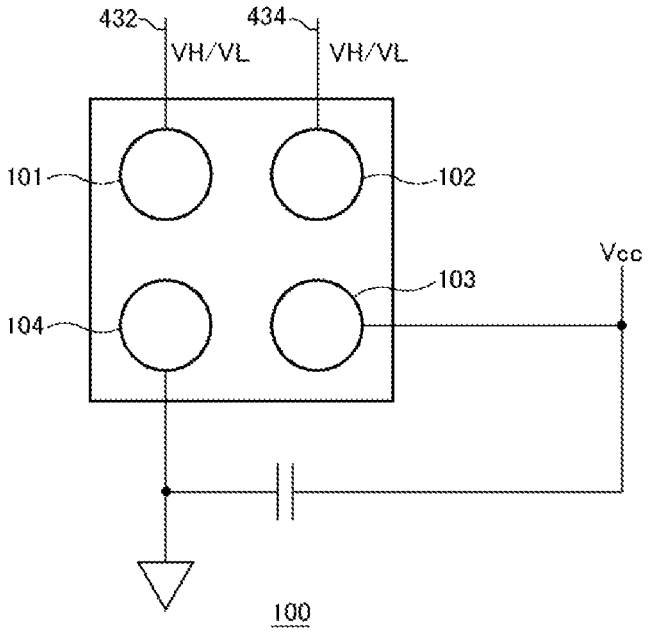
FIG. 2A is a schematic diagram of a device 100.

FIG. 2A is a schematic diagram of a device 100. The device 100 in this example includes a power source terminal 103 and a power source terminal 104 in addition to the clock terminal 101 and the data terminal 102. In this example, the power source terminal 103 is applied with power source voltage Vcc, and the power source terminal 104 is applied with reference potential. The reference potential is, for example, ground potential.

The clock terminal 101 and the data terminal 102 are each configured to be inputted with a clock signal and a data signal. The clock signal and the data signal in this example are each a binary (for example, logical values L and H) signal. In FIG. 2A, signal potential for when a logical value is H is VH, and signal potential for when a logical value is L is VL. The signal potential VH is potential corresponding to the power source potential Vdd applied by the power source unit 420, and is an example of a target level. The signal potential VH may be signal potential SCL_H of the clock signal line 432 or signal potential SDA_H of the data signal line 434. The signal potential VL may be ground potential.

The power source voltage Vcc of the device 100 is different from the signal potential VH. Therefore, a power source of the signal potential VH may be required when a data signal of the signal potential VH is outputted from the device 100. The device 100 in this example takes in signal potential VH of the interface 400, and is not required to be connected with a power source of the signal potential VH.

The device 100 in this example is configured to recognize the signal potential VH different from the power source voltage Vcc to realize send/receive. That is, the device 100 does not require a power source for an interface for sending/receiving to/from a high level of the interface 400. Therefore, the device 100 in this example is not required to provide a new terminal for the power source for the interface, and includes four terminals.

Figure 2B:
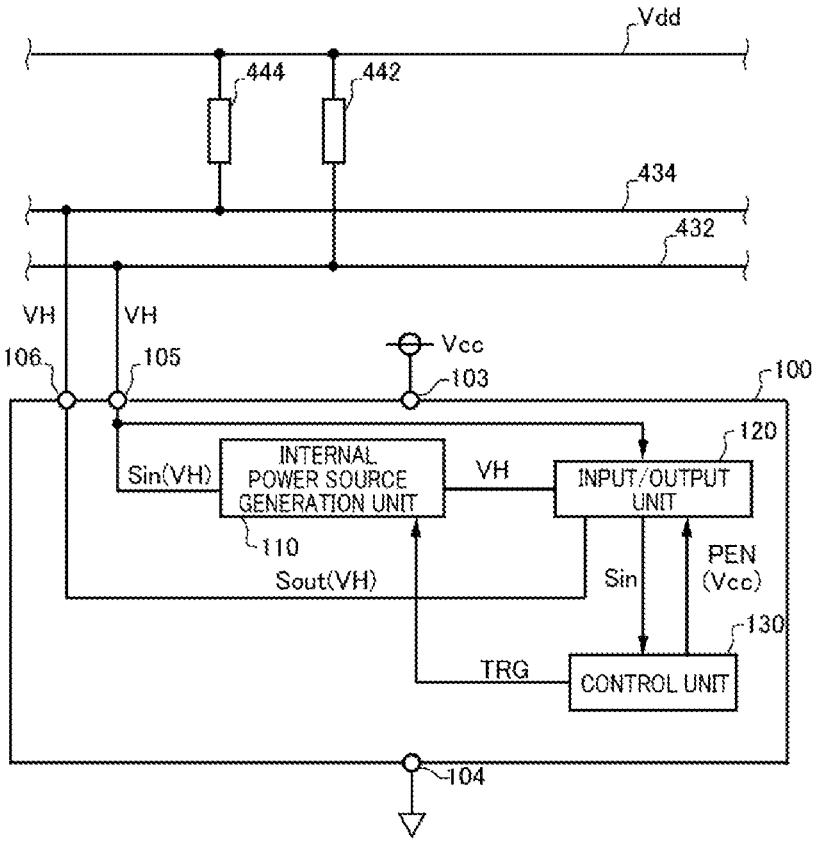
FIG. 2B is a block diagram showing an example of the device 100.

FIG. 2B is a block diagram showing an example of the device 100. The device 100 is connected to the interface 400 having a communication line, and is configured to generate an output signal Sout of a target level that is a level corresponding to a high level of an input signal Sin. The device 100 in this example includes an internal power source generation unit 110, an input/output unit 120, and a control unit 130. The device 100 includes an input terminal 105 and an output terminal 106.

The input terminal 105 is a terminal inputted with a signal from the interface 400. The input terminal 105 may be either the clock terminal 101 or the data terminal 102 described with reference to FIG. 2A. The input terminal 105 is configured to receive a clock signal or a data signal in order to detect the signal potential VH in the interface 400. The input terminal 105 in this example is connected to the internal power source generation unit 110.

The output terminal 106 is a terminal for outputting a signal to the interface 400. The output terminal 106 may be the data terminal 102 described with reference to FIG. 2A. The output terminal 106 in this example is connected to the data signal line 434. The input terminal 105 and the output terminal 106 may be the same terminal. As an example, the data terminal 102 may function as both the input terminal 105 and the output terminal 106.

The internal power source generation unit 110 is configured to generate an internal power source of the device 100. For example, the internal power source generation unit 110 is configured to generate high level VH. The internal power source generation unit 110 is connected in series with the input/output unit 120 between the input terminal 105 and the output terminal 106. The internal power source generation unit 110 in this example is configured to generate the high level VH to supply it to the input/output unit 120.

The input/output unit 120 is configured to output a signal of the high level VH or the power source voltage Vcc in response to the high level VH. For example, the input/output unit 120 is configured to output an output signal Sout of the high level VH to the output terminal 106. Moreover, the input/output unit 120 may input the signal of the power source voltage Vcc to the control unit 130. The input/output unit 120 may be connected with the input terminal 105, and be inputted with the input signal Sin.

The control unit 130 is configured to operate with the power source voltage Vcc to control operation of the input/output unit 120. The control unit 130 is configured to output a control signal PEN of the power source voltage Vcc to the input/output unit 120. Moreover, the control unit 130 may be inputted with the input signal Sin of the power source voltage Vcc from the input/output unit 120. Furthermore, the control unit 130 may output a trigger signal TRG for activating the internal power source generation unit 110.

For example, the control unit 130 is configured to control, based on a data pattern of the output signal Sout to be outputted by the device 100, the input/output unit 120 to output the output signal Sout having the data pattern. The data pattern of the output signal Sout may be prestored by the control unit 130, or may be generated by the control unit 130 based on a data signal inputted from the interface 400. The data pattern is a pattern showing an aspect where a logical value of the output signal Sout is changed in time series.

Thus, the device 100 can match potential of the signal outputted from the output terminal 106 with the signal potential in the interface 400. Moreover, even when a step-down element such as a MOSFET causing a voltage drop is included between the input terminal 105 and the input/output unit 120, the device 100 can cancel the voltage drop by stepping up voltage inside the device 100.

Figure 3A:
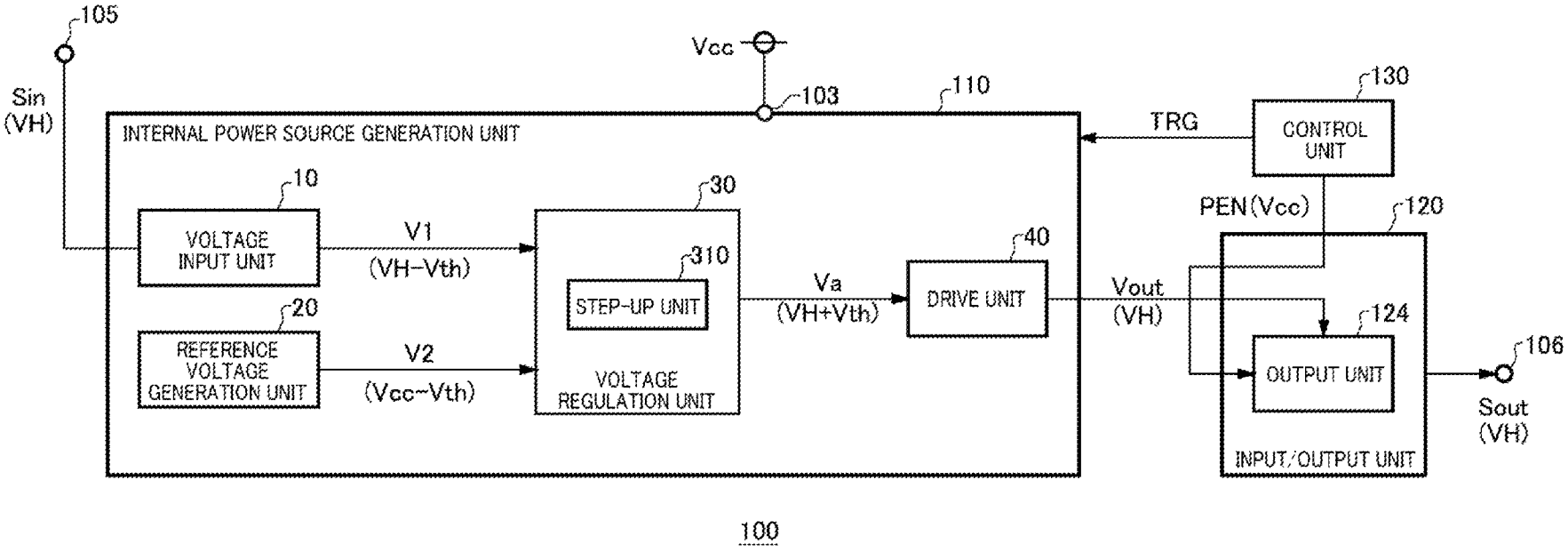
FIG. 3A is a block diagram showing an example of the device 100.

FIG. 3A is a block diagram showing an example of the device 100. The internal power source generation unit 110 in this example includes a voltage input unit 10, a reference voltage generation unit 20, a voltage regulation unit 30, and a drive unit 40. The input/output unit 120 includes an output unit 124.

The voltage input unit 10 is configured to be inputted with the input signal Sin, and to generate first reference voltage V1. The voltage input unit 10 in this example is configured to step down a signal at a level corresponding to the high level VH by a predetermined magnitude to generate the first reference voltage V1. The voltage input unit 10 in this example is configured to step down the input signal Sin of the high level VH by Vth to generate the first reference voltage (VH-Vth). The first reference voltage V1 is an example of step-up reference voltage that serves as a reference for stepping up voltage with the voltage regulation unit 30.

The reference voltage generation unit 20 is configured to be inputted with a predetermined input voltage, and to generate second reference voltage V2. The reference voltage generation unit 20 in this example is configured to step down the predetermined input voltage to generate the second reference voltage V2. The input voltage of the reference voltage generation unit 20 is the power source voltage Vcc of the device 100. The reference voltage generation unit 20 in this example is configured to step down the input voltage Vcc by Vth to generate the second reference voltage (Vcc- Vth). The second reference voltage V2 is an example of charging reference voltage used to charge a capacitor of the voltage regulation unit 30.

The voltage regulation unit 30 is configured to generate regulation voltage Va by using the second reference voltage V2 to convert a level of the first reference voltage V1. The voltage regulation unit 30 includes a step-up unit 310.

The step-up unit 310 is configured to step up the first reference voltage V1 by a magnitude of a voltage drop in the drive unit 40. In an example, the step-up unit 310 is configured to use the second reference voltage V2 to step up voltage by a magnitude obtained by adding the magnitude of the voltage drop in the drive unit 40 to a magnitude of a voltage drop in the voltage input unit 10. For example, the step-up unit 310 is configured to step up voltage by 2Vth obtained by adding the voltage drop Vth in the drive unit 40 to the voltage drop Vth in the voltage input unit 10. The voltage regulation unit 30 in this example is configured to generate the regulation voltage (VH+Vth) obtained by stepping up the first reference voltage (VH-Vth) by 2Vth.

The drive unit 40 is configured to step down the regulation voltage Va to generate output voltage Vout. The drive unit 40 in this example is configured to generate the output voltage VH by stepping down the regulation voltage (VH+Vth) of the voltage regulation unit 30 by Vth. The drive unit 40 is further configured to supply drive current to the input/output unit 120.

The output unit 124 is connected with the control unit 130, the drive unit 40, and the communication line. The output unit 124 is configured to, when a high level is inputted from the control unit 130, convert it into the output voltage VH, and to, when a low level is inputted, output VL to the communication line. The output unit 124 in this example is configured to output, as a high level, the output signal Sout of the output voltage VH to the output terminal 106. The output voltage VH is regulated to correspond to the signal potential VH that is a target level.

The control unit 130 is configured to activate the internal power source generation unit 110 with a trigger signal TRG. For example, the control unit 130 is configured to detect a chip select, start condition, or the like indicating that there is access to the device 100, to generate the trigger signal TRG. Moreover, the control unit 130 is configured to output, as output data, the control signal PEN whose high level is the power source voltage Vcc, to the output unit 124.

Figure 3B:
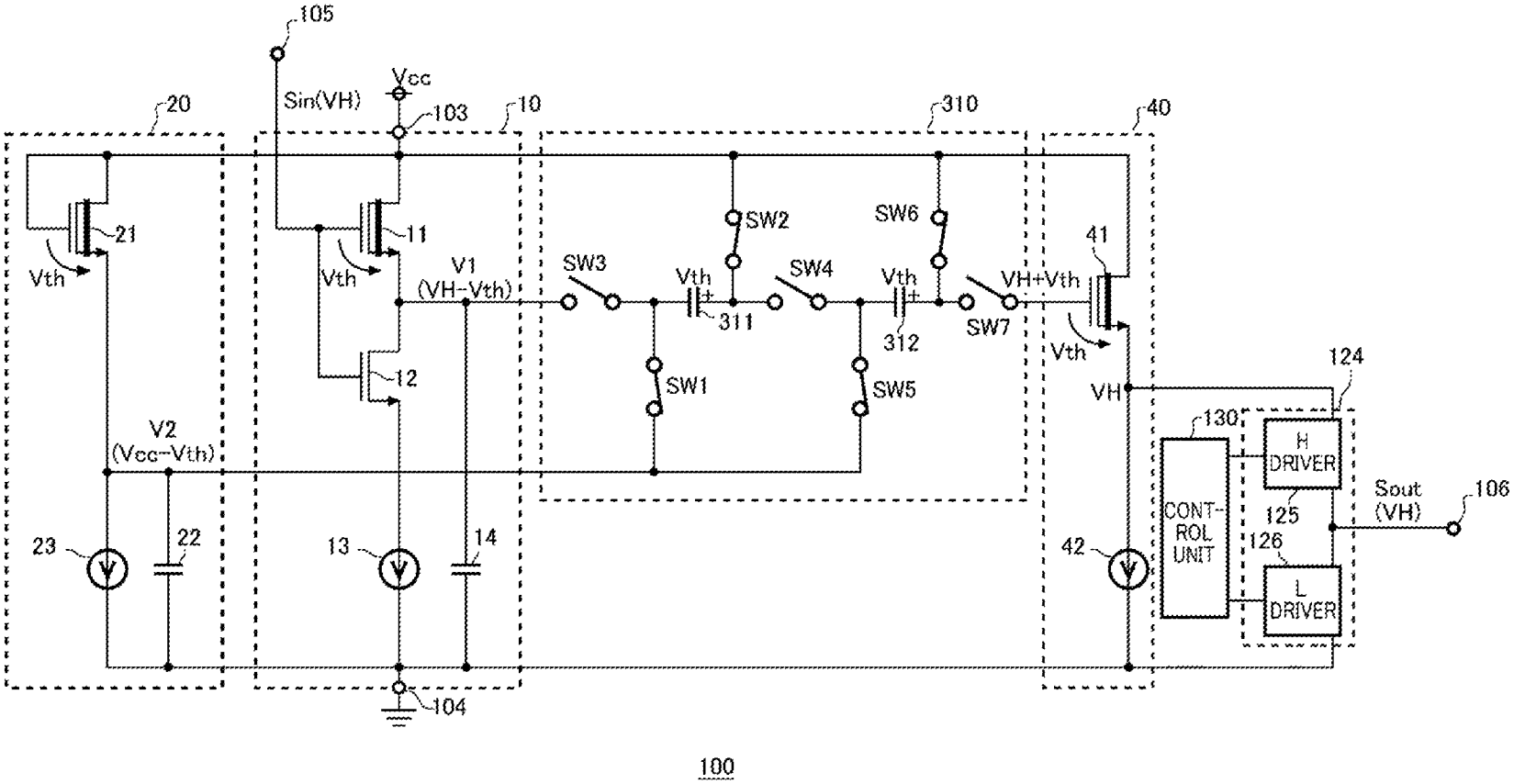
FIG. 3B shows an example of a concrete circuit configuration of the device 100 in FIG. 3A.

FIG. 3B shows an example of a concrete circuit configuration of the device 100 in FIG. 3A. The circuit configuration of the device 100 in this example is an example, and is not limited thereto.

The voltage input unit 10 includes a step-down element 11, a transistor 12, a current source 13, and a capacitor 14. The voltage input unit 10 is an example of a voltage input unit having a peak hold circuit. The voltage input unit 10 in this example is configured to step down the high level VH by Vth to generate the first reference voltage V1.

The step-down element 11 is configured to step down the high level VH by Vth. A drain terminal of the step-down element 11 is connected with the power source terminal 103. A gate terminal of the step-down element 11 is connected with the input terminal 105. A source terminal of the step-down element 11 is connected with a drain terminal of the transistor 12.

The transistor 12 is connected in series with the step-down element 11. A gate terminal of the transistor 12 is connected with the input terminal 105. A source terminal of the transistor 12 is connected with the current source 13. A connection point between the step-down element 11 and the transistor 12 is connected with a high-voltage side terminal of the capacitor 14.

The capacitor 14 is configured to accumulate electric charge corresponding to the first reference voltage V1. Inter-terminal voltage of the capacitor 14 in this example is VH-Vth. The high-voltage side terminal of the capacitor 14 is connected with the step-up unit 310.

The reference voltage generation unit 20 includes a step-down element 21, a capacitor 22, and a current source 23. The reference voltage generation unit 20 in this example is configured to step down input voltage Vin by Vth to generate the second reference voltage V2.

The step-down element 21 is configured to step down the power source voltage Vcc that is the input voltage Vin, by voltage Vth of a predetermined magnitude. In this example, a voltage drop by the step-down element 21 is equal to the voltage drop in the drive unit 40. A drain terminal and a gate terminal of the step-down element 21 are connected to the power source terminal 103. A source terminal of the step-down element 21 is connected with the current source 23. The step-down element 21 is configured to function as a source follower circuit. The step-down element 21 is configured to generate the second reference voltage (Vcc-Vth) dropped by Vth.

The step-down element herein refers to, for example, an element having a MOS structure. The MOS structure is a structure where an insulation film is provided between a semiconductor substrate and a metal electrode. The element having the MOS structure may be a MOSFET. In this case, the voltage drop refers to gate-source potential difference of the MOSFET.

A voltage drop amount in the step-down element is preferably the same. When referred to as "the same" herein, an error of 10% or less may be allowed. The step-down element is preferably a MOSFET with the same structure, formed in the same semiconductor substrate. The same structure may refer to a structure where its channel width and channel length are the same, conductive type of its channel is the same, impurity concentration of its channel is the same, and material and thickness of its gate insulation film are the same. A step-down element is preferably formed in parallel by a common process.

The capacitor 22 is provided between the source terminal of the step-down element 21 and ground. The capacitor 22 is configured to accumulate electric charge corresponding to the second reference voltage V2. This causes inter-terminal voltage of the capacitor 22 to be set to the second reference voltage V2. A high-voltage side terminal of the capacitor 22 is connected with the step-up unit 310.

The step-up unit 310 includes capacitors 311 and 312. The step-up unit 310 includes switches SW1 to SW7 for switching charge/discharge of the capacitors.

The capacitors 311 and 312 are connected with the reference voltage generation unit 20, and are configured to accumulate step-up electric charge. The capacitors 311 and 312 in this example are connected between the power source terminal 103 and the high-voltage side terminal of the capacitor 22.

When charging, the step-up unit 310 is configured to charge each of the capacitors 311 and 312 by Vth. For example, the capacitor 311 is charged by turning on the switches SW1 and SW2 and turning off the switches SW3 and SW4. This makes inter-terminal voltage of the capacitor 311, Vth. Likewise, the capacitor 312 is charged by turning on the switches SW5 and SW6 and turning off the switches SW4 and SW7. This makes inter-terminal voltage of the capacitor 312, Vth.

During step-up, the step-up unit 310 is configured to connect the capacitors 311 and 312 in series to step up voltage by 2Vth. For example, the step-up unit 310 is configured to step up the first reference voltage V1 by 2Vth to generate the regulation voltage (VH+Vth), by turning off the switches SW1, SW2, SW5, and SW6 and turning on the switches SW3, SW4, and SW7.

The drive unit 40 includes a step-down element 41 and a current source 42. The step-down element 41 and the current source 42 are connected in series between the power source terminal 103 and the power source terminal 104. The current source 42 is provided between a source terminal of the step-down element 41 and the power source terminal 104, and is configured to define current flowing through the step-down element 41.

The step-down element 41 is configured to step down the regulation voltage Va to generate the high level VH. A gate terminal of the step-down element 41 is connected with the step-up unit 310. A drain terminal of the step-down element 41 is connected to the power source terminal 103. The source terminal of the step-down element 41 is connected with the output unit 124. The step-down element 41 is configured to function as a source follower circuit.

The output unit 124 is configured to receive the drive current from the drive unit 40, and to output high level or low level output signal Sout in response to the control signal PEN from the control unit 130. The output unit 124 is configured to output the output signal Sout of the VH as a high level from a high-side driver 125. Moreover, the output unit 124 is configured to output an output signal Sout of ground potential as a low level from a low-side driver 126.

The device 100 in this example can output the output signal Sout of the signal potential VH of the interface 400 even when a step-down element causing a voltage drop is included. That is, the device 100 in this example is not required to provide a native MOSFET causing no voltage drop. This can simplify a manufacturing process to reduce costs.

Note that the native MOSFET is, for example, a MOSFET using a natural oxide film as a gate insulation film. A channel of the native MOSFET may be a bulk portion of the semiconductor substrate. The native MOSFET may have threshold voltage of approximately 0V.

According to the device 100 in this example, a step-down in the drive unit 40 can be cancelled by a step-up in the step-up unit 310. Moreover, when a voltage drop amount of the drive unit 40 is fluctuated, the voltage drop amount of the step-down element is also fluctuated so that influence caused by the fluctuation of the voltage drop amount can be suppressed. Accordingly, the device 100 can accurately match potential of the output signal Sout outputted from the output terminal 106 with the signal potential VH in the interface 400.

Figure 4A:
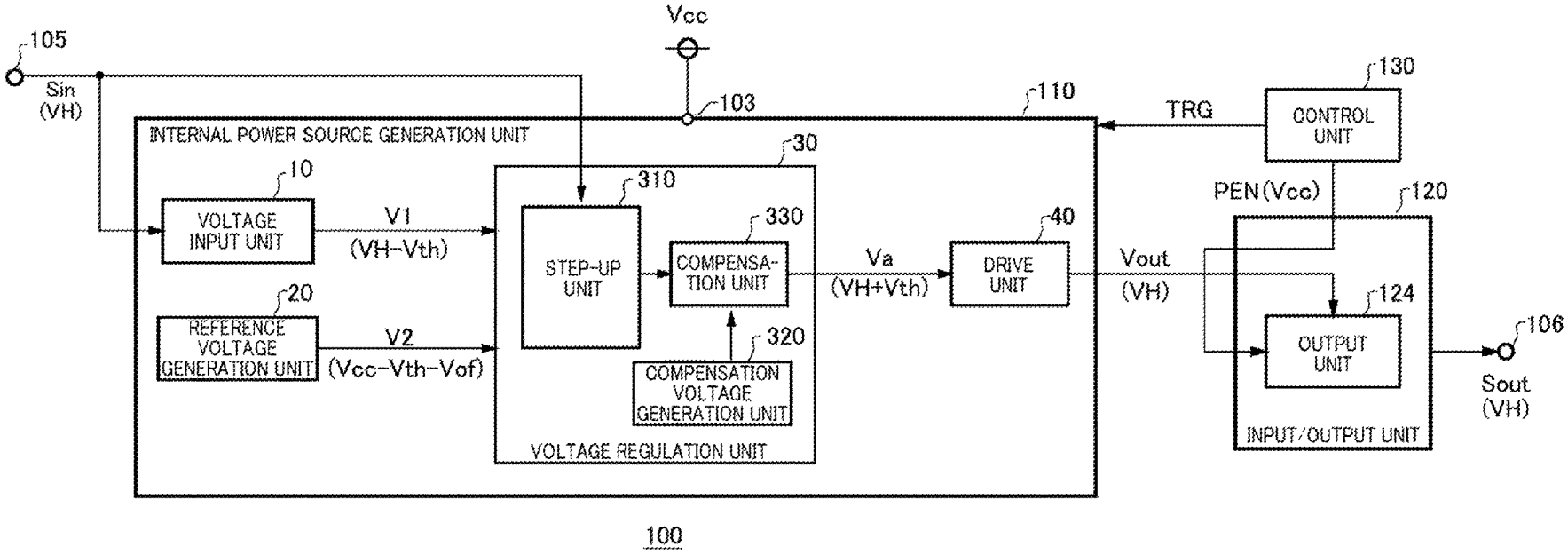
FIG. 4A is a block diagram showing an example of the device 100.

FIG. 4A is a block diagram showing an example of the device 100. In this example, difference with FIG. 3A will be particularly described. The voltage regulation unit 30 in this example includes a compensation voltage generation unit 320 and a compensation unit 330 in addition to the step-up unit 310.

The compensation voltage generation unit 320 is configured to generate compensation voltage for supplying to the compensation unit 330. For example, the compensation voltage is voltage for suppressing influence of voltage fluctuation. In an example, the compensation voltage generation unit 320 is configured to generate the compensation voltage corresponding to difference between the target level and the output voltage Vout. Moreover, the compensation voltage generation unit 320 is configured to generate the compensation voltage based on difference between the voltage drop in the voltage input unit 10 and a voltage drop in the reference voltage generation unit 20.

The compensation unit 330 is configured to use the compensation voltage to convert a level of the regulation voltage Va. The compensation unit 330 in this example is configured to generate voltage-compensated regulation voltage Va by stepping up or stepping down voltage by the compensation voltage. This allows the compensation unit 330 to compensate for a change in voltage caused in an internal circuit of the device 100. That is, the compensation unit 330 can bring the output voltage Vout closer to the target level. While the compensation unit 330 in this example is provided downstream of the step-up unit 310, it may be provided upstream of the step-up unit 310.

For example, the compensation unit 330 is configured to step down voltage by offset voltage Vof generated by the reference voltage generation unit 20. This causes the voltage regulation unit 30 to generate the regulation voltage Va obtained by compensating for the offset voltage Vof of the reference voltage generation unit 20.

Note that the compensation voltage generation unit 320 may generate the compensation voltage based on at least one of difference between the regulation voltage Va and the target level or difference between the output voltage Vout and the target level. This allows the compensation voltage generation unit 320 to generate the compensation voltage for when the regulation voltage Va or the output voltage Vout is affected by voltage fluctuation caused by an external load of the device 100.

Figure 4B:
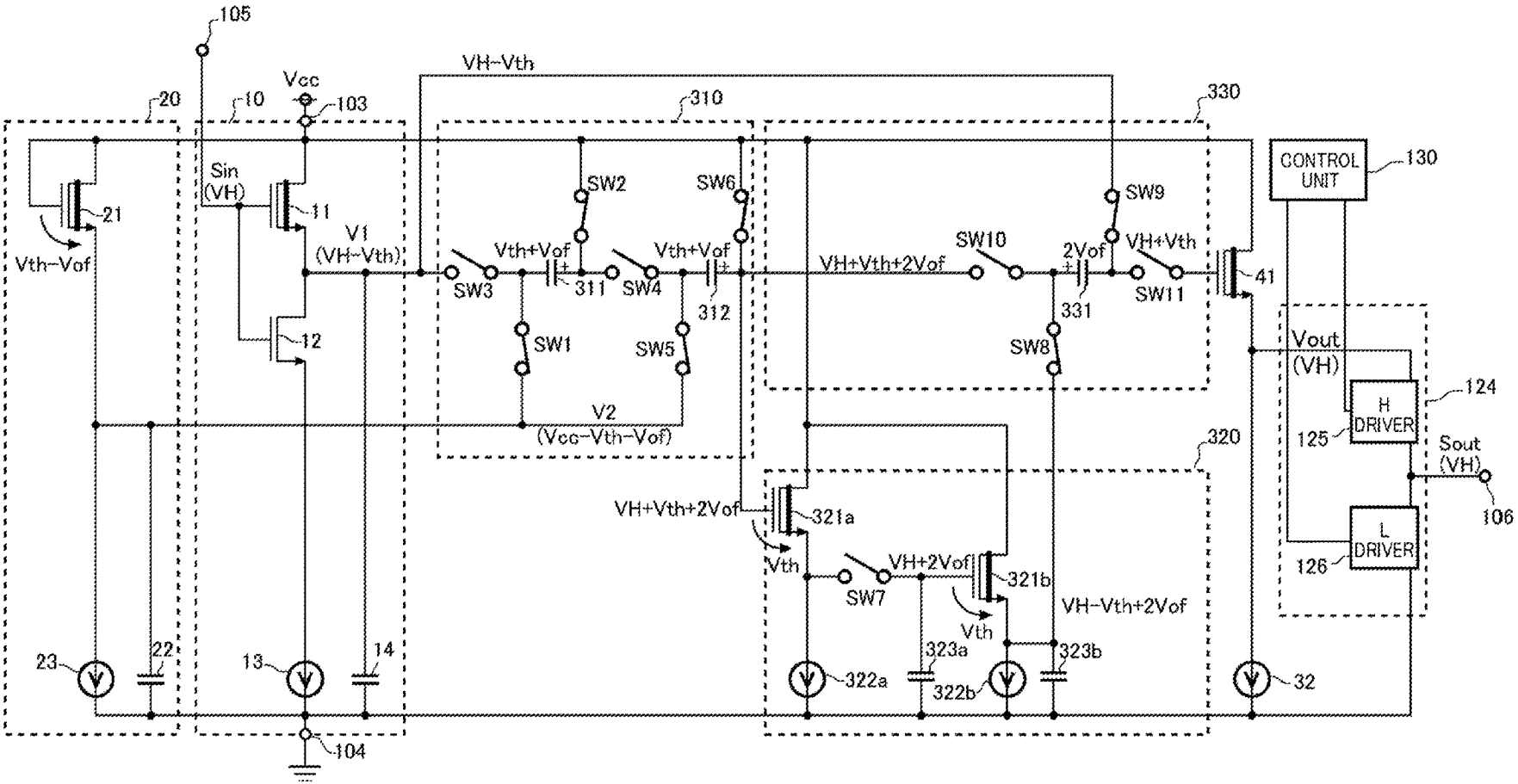
FIG. 4B shows an example of a more concrete circuit configuration of the device 100 in FIG. 4A.

FIG. 4B shows an example of a more concrete circuit configuration of the device 100 in FIG. 4A. In this example, difference with FIG. 3B will be particularly described.

The circuit configuration of the reference voltage generation unit 20 is the same as that of the reference voltage generation unit 20 according to the example embodiment in FIG. 3B. In the reference voltage generation unit 20 in this example, a step-down by the offset voltage Vof as well as Vth is caused in the step-down element 21. Therefore, the second reference voltage V2 in this example is Vcc-Vth-Vof.

The circuit configuration of the step-up unit 310 is the same as that of the step-up unit 310 according to the example embodiment in FIG. 3B. However, the second reference voltage V2 is Vcc-Vth-Vof, which makes the inter-terminal voltage of each of the capacitors 311 and 312 Vth+Vof.

The compensation voltage generation unit 320 in this example includes a step-down element 321, a current source 322, a capacitor 323, and a switch SW7. The compensation unit 330 includes a capacitor 331 and switches SW8 to SW11.

The step-down element 321*a* is configured to step down voltage (VH+Vth+2Vof) of the step-up unit 310 by Vth to generate voltage (VH+2Vof). A source terminal of the step-down element 321*a* is connected with the current source 322*a*. The source terminal of the step-down element 321*a* is connected with a high-voltage side terminal of the capacitor 323*a* via the switch SW7.

The capacitor 323*a* is charged when the switches SW3, SW4, SW7, SW10, and SW11 are turned on and when the switches SW1, SW2, SW5, SW6, SW8, and SW9 are turned off. This makes inter-terminal voltage of the capacitor 323*a*, VH+2Vof.

The step-down element 321*b* is configured to further step down the voltage (VH+2Vof) by Vth to generate voltage (VH-Vth+2Vof). A source terminal of the step-down element 321*b* is connected with the current source 322*b* and a high-voltage side terminal of the capacitor 323*b*. Inter-terminal voltage of the capacitor 323*b* becomes VH-Vth+2Vof.

The capacitor 331 includes a first compensation terminal connected with the step-up unit 310 via the switch SW10, and a second compensation terminal connected with the step-down element 41 via the switch SW11. Furthermore, the first compensation terminal is connected to the capacitor 323*b* via the switch SW8, and the second compensation terminal is connected to the voltage input unit 10 via the switch SW9. Accordingly, electric charge corresponding to the offset voltage Vof is accumulate by turning on the switches SW8 and SW9 and turning off the switches SW10 and SW11. As a result, inter-terminal voltage of the capacitor 331 becomes 2Vof, which is difference between potential corresponding to the electric charge accumulated in the capacitor 323*b*, and the first reference voltage V1. Subsequently, potential difference of the second compensation terminal with respect to the first compensation terminal becomes −2Vof by turning off the switches SW8 and SW9 and turning on the switches SW10 and SW11. As a result, the compensation unit 330 is configured to generate the regulation voltage (VH+Vth) by fluctuating a level by −2Vof with respect to potential generated in the step-up unit 310. This compensates the offset voltage Vof of the reference voltage generation unit 20.

Figure 5A:
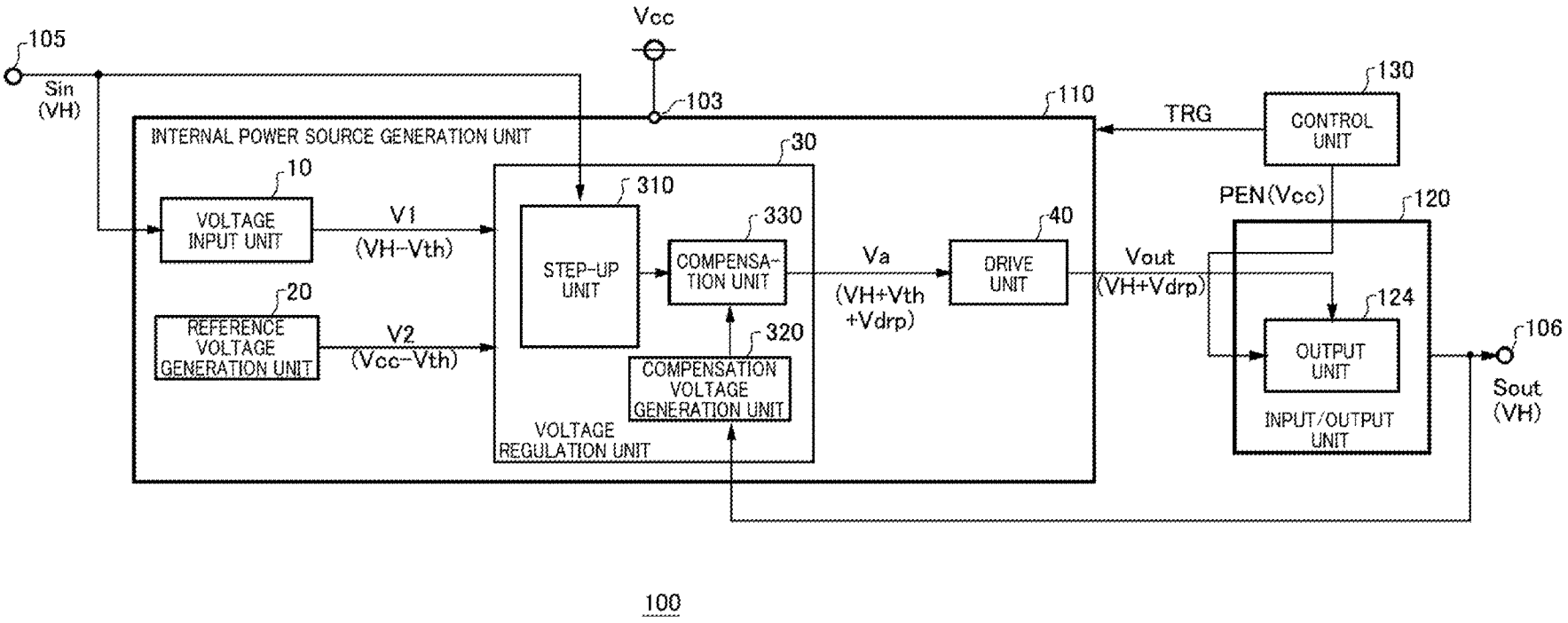
FIG. 5A is a block diagram showing an example of the device 100.

FIG. 5A is a block diagram showing an example of the device 100. The compensation voltage generation unit 320 in this example is different from the one in the example embodiment of FIG. 4A in that the compensation voltage is generated based on voltage of the output signal Sout. In this example, difference with FIG. 4A will be particularly described.

The compensation voltage generation unit 320 is configured to detect the voltage of the output signal Sout to generate the compensation voltage. The compensation voltage generation unit 320 in this example is configured to generate the compensation voltage corresponding to a voltage drop Vdrop in the output unit 124. For example, the voltage drop Vdrop is caused by on-resistance of a driver of the output unit 124. Note that the compensation voltage generation unit 320 may store the compensation voltage corresponding to the voltage drop Vdrop and repeatedly use the stored compensation voltage.

The compensation unit 330 is configured to compensate for the voltage drop Vdrop in the output unit 124. The compensation unit 330 in this example is configured to compensate for the voltage drop in the output unit 124 by stepping up the regulation voltage Va by voltage Vdrp.

Figure 5B:
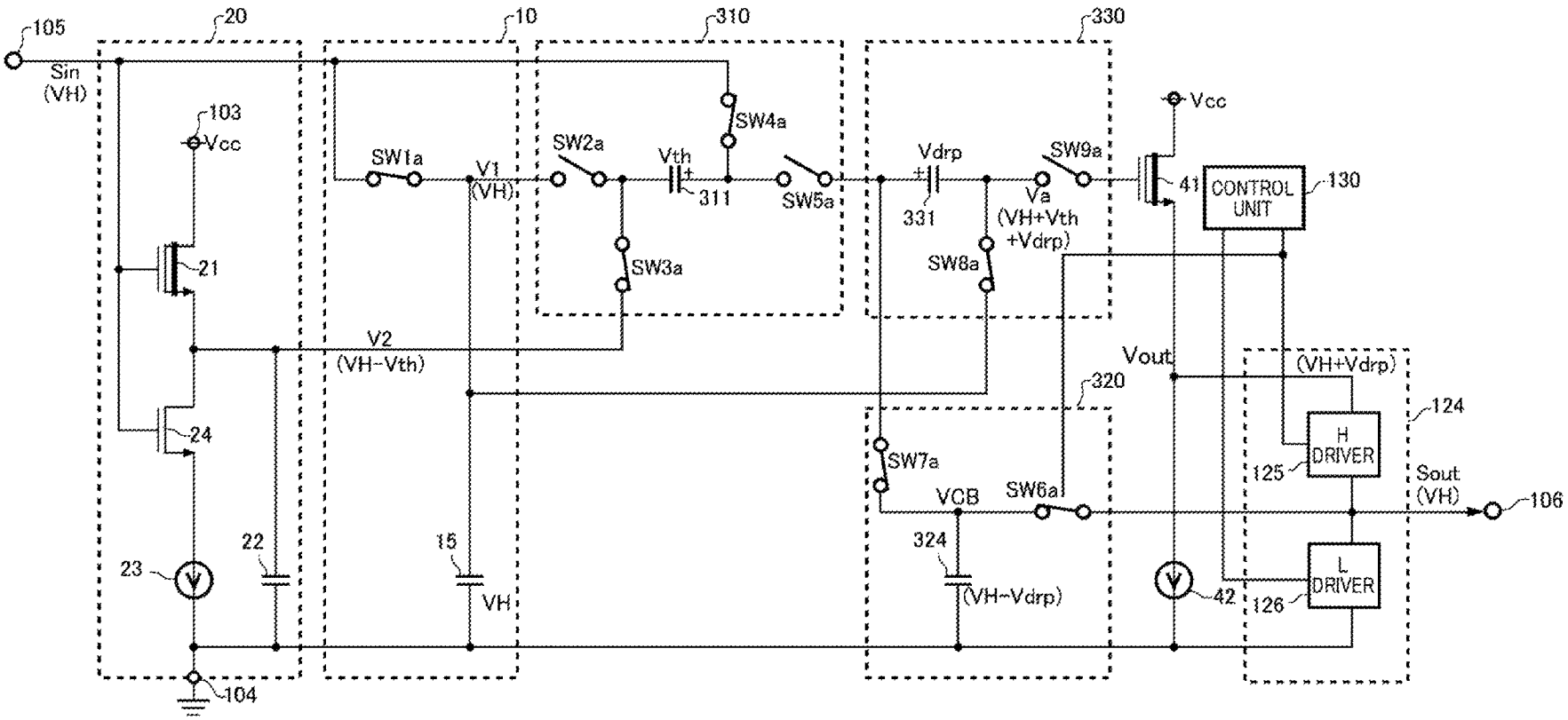
FIG. 5B shows an example of a more concrete circuit configuration of the device 100 in FIG. 5A.

FIG. 5B shows an example of a more concrete circuit configuration of the device 100 in FIG. 5A. The device 100 in this example is an example for when a sample-and-hold circuit is used for the voltage input unit 10.

The voltage input unit 10 is configured to be inputted with the input signal Sin, and to generate the first reference voltage V1. The voltage input unit 10 includes a capacitor 15, a switch SW1*a*, and a switch SW2*a*. Since the voltage input unit 10 in this example is not provided with a step-down element, no voltage drop Vth is caused. Therefore, the voltage input unit 10 is configured to generate the first reference voltage V1 of the high level VH.

The capacitor 15 is charged by turning on the switch SW1*a* and turning off the switch SW2*a*. The switches SW1*a* and SW2*a* are switched on/off in response to the high level of the input signal Sin. This makes inter-terminal voltage of the capacitor 15, VH. Thus, the voltage input unit 10 can generate the voltage corresponding to the voltage VH of the input signal Sin.

The reference voltage generation unit 20 is configured to be inputted with the input signal Sin, and to generate the second reference voltage V2. Therefore, the input voltage Vin of the reference voltage generation unit 20 in this example becomes VH. The reference voltage generation unit 20 includes a step-down element 21, a capacitor 22, a current source 23, and a transistor 24. The reference voltage generation unit 20 in this example is configured to step down the voltage VH by Vth to generate the second reference voltage (VH-Vth).

The step-down element 21 is connected in series with the current source 23 and the transistor 24. Gate terminals of the step-down element 21 and the transistor 24 are connected with the input terminal 105. A drain terminal of the step-down element 21 is connected with the power source terminal 103. A source terminal of the step-down element 21 is connected with a drain terminal of the transistor 24. A connection point between the step-down element 21 and the transistor 24 is connected with the high-voltage side terminal of the capacitor 22.

The capacitor 22 is configured to accumulate electric charge corresponding to the second reference voltage V2. Inter-terminal voltage of the capacitor 22 in this example is VH-Vth. The high-voltage side terminal of the capacitor 22 is connected with the step-up unit 310.

The step-up unit 310 is configured to use the second reference voltage V2 to step up voltage by a magnitude of the voltage drop in the drive unit 40. The step-up unit 310 includes a capacitor 311 and switches SW3*a* to SW5*a*.

The capacitor 311 is charged by turning on the switches SW3*a* and SW4*a* and turning off the switches SW2*a* and SW5*a*. When charged, the capacitor 311 is connected between the input terminal 105 and the high-voltage side terminal of the capacitor 22. Inter-terminal voltage of the capacitor 311 becomes Vth by difference between the voltage VH and the voltage (VH-Vth) of the second reference voltage V2.

The compensation voltage generation unit 320 includes a capacitor 324, a switch SW6*a*, and a switch SW7*a*. The switch SW6*a* is on/off controlled by the control unit 130.

The capacitor 324 is connected to a connection node between the high-side driver 125 and the low-side driver 126 via the switch SW6*a*. Voltage VCB of a high-voltage side terminal of the capacitor 324 becomes voltage (VH-Vdrp) when a voltage drop Vdrop is caused in the output unit 124.

The compensation unit 330 includes a capacitor 331, a switch SW8*a*, and a switch SW9*a*. The compensation unit 330 is configured to compensate for the voltage drop in the output unit 124 based on compensation voltage of the compensation voltage generation unit 320.

The capacitor 331 is connected with the high-voltage side terminal of the capacitor 324 via the switch SW7*a*. For example, the capacitor 331 is configured to accumulate electric charge corresponding to the voltage drop Vdrop by turning on the switches SW7*a* and SW8*a* and turning off the switches SW5*a* and SW9*a*. Inter-terminal voltage of the capacitor 331 becomes Vdrp by difference between the voltage VH and inter-terminal voltage (VH-Vdrp) of the capacitor 324.

The voltage regulation unit 30 is configured to step up the voltage VH of the first reference voltage V1 by Vth in the step-up unit 310 to compensate by Vdrp in the compensation unit 330. Therefore, the voltage regulation unit 30 can generate the regulation voltage (VH+Vth+Vdrp). This allows the device 100 to compensate for the voltage drop of the output unit 124.

Figure 5C:
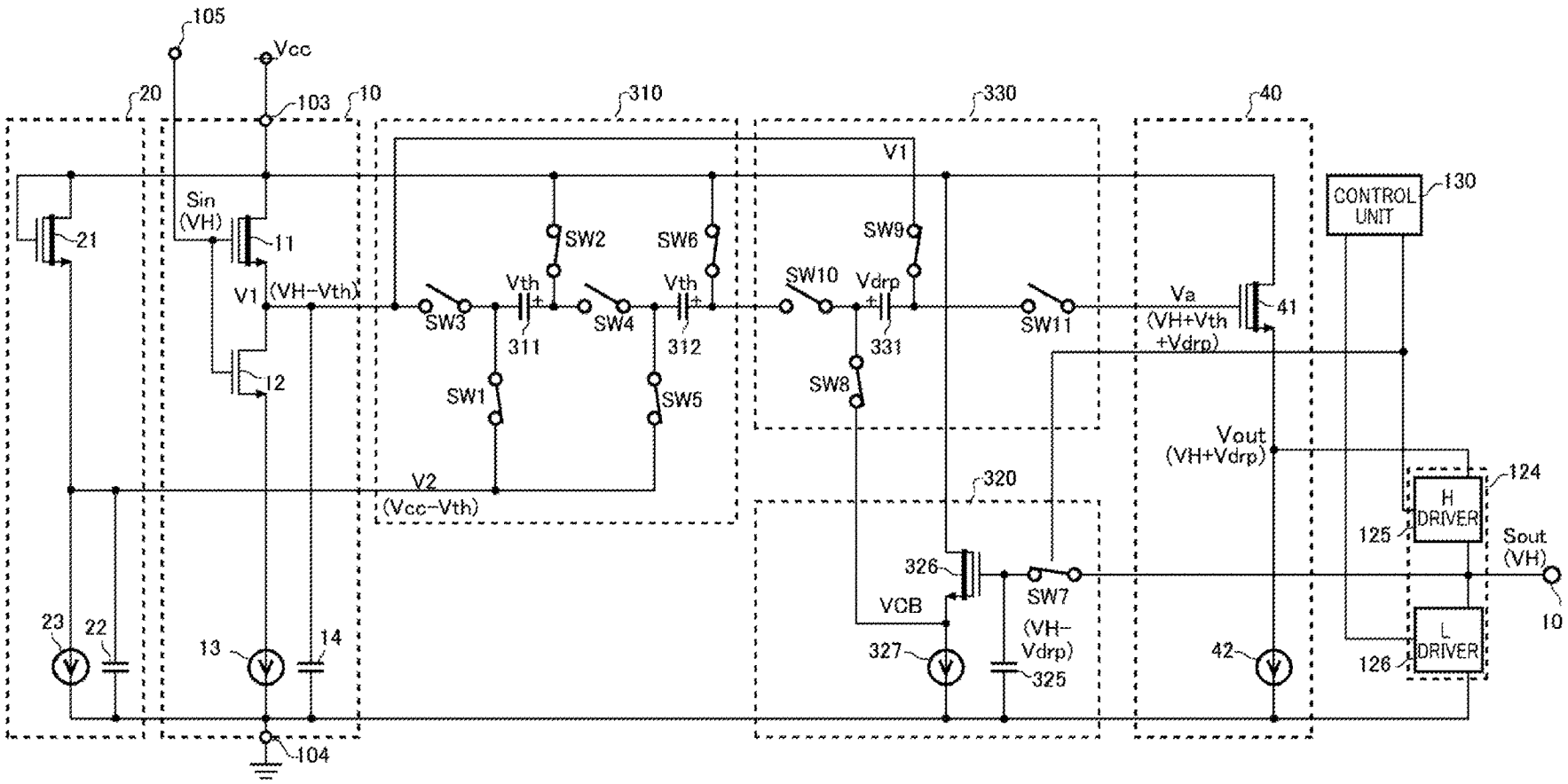
FIG. 5C shows an example of a more concrete circuit configuration of the device 100 in FIG. 5A.

FIG. 5C shows an example of a more concrete circuit configuration of the device 100 in FIG. 5A. The device 100 in this example as an example for when a peak hold circuit is used for the voltage input unit 10. In this example, difference with FIG. 5B will be particularly described.

The circuit configurations of the voltage input unit 10 and the reference voltage generation unit 20 are the same as the circuit configurations in FIG. 3B. The voltage input unit 10 in this example is different from the one in FIG. 5B in that it includes a peak hold circuit and that a voltage drop Vth is caused by the step-down element 11.

The circuit configuration of the step-up unit 310 is the same as the circuit configuration in FIG. 3B.

The compensation voltage generation unit 320 includes a capacitor 325, a transistor 326, a current source 327, and a switch SW7. The switch SW7 is on/off controlled by the control unit 130.

The capacitor 325 is connected to the connection node between the high-side driver 125 and the low-side driver 126 via the switch SW7. Inter-terminal voltage of the capacitor 325 becomes voltage (VH-Vdrp) when a voltage drop Vdrop is caused in the output unit 124.

The transistor 326 is connected in series with the current source 327. A gate terminal of the transistor 326 is connected to a high-voltage side terminal of the capacitor 325. A source terminal of the transistor 326 is connected with the current source 327. Voltage VCB of a source terminal of the current source 327 becomes voltage (VH-Vth-Vdrp).

The compensation unit 330 includes a capacitor 331 and switches SW8 to SW11. The compensation unit 330 is configured to compensate for the voltage drop in the output unit 124 based on the compensation voltage of the compensation voltage generation unit 320.

The capacitor 331 is connected with the source terminal of the transistor 326 via the switch SW8. For example, the capacitor 331 is configured to accumulate electric charge corresponding to the voltage drop Vdrop by turning on the switches SW8 and SW9 and turning off the switches SW10 and SW11. Inter-terminal voltage of the capacitor 331 becomes Vdrp by difference between voltage (VH-Vth) of the first reference voltage V1 and voltage (VH-Vth-Vdrp) of the source terminal of the transistor 326.

Therefore, the voltage regulation unit 30 can generate the regulation voltage (VH+Vth+Vdrp) obtained by adding 2Vth and Vdrp to the voltage (VH-Vth) of the first reference voltage V1. This allows the device 100 to compensate for the voltage drop of the output unit 124.

Figure 6:
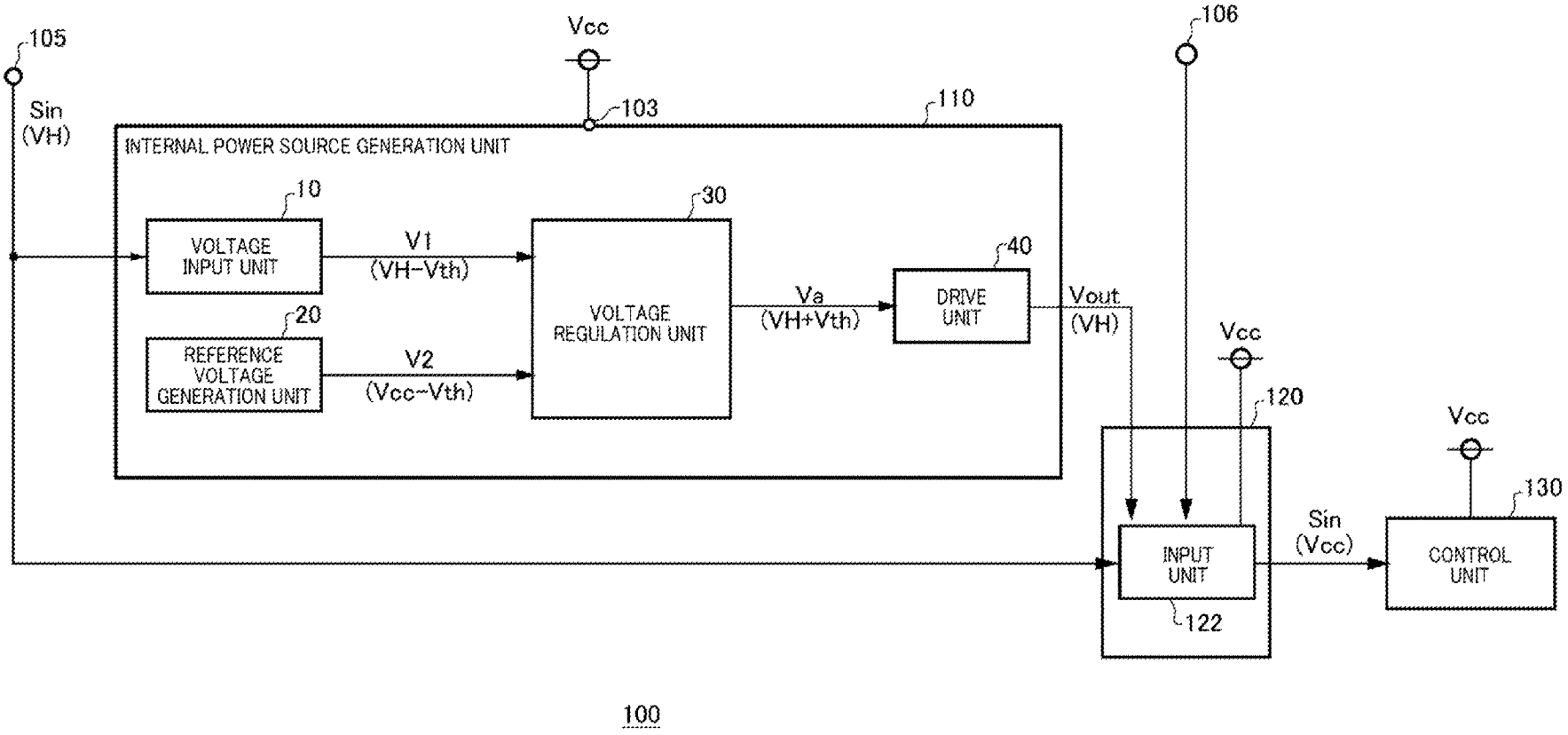
FIG. 6 is a block diagram showing an example of the device 100.

FIG. 6 is a block diagram showing an example of the device 100. The input/output unit 120 in this example includes an input unit 122. The input/output unit 120 may include both an input unit 122 and an output unit 124. The device 100 in this example is configured to input, by the internal power source generation unit 110, a signal corresponding to the high level VH of the input signal Sin to the input unit 122. The control unit 130 is connected to the power source terminal 103 of the power source voltage Vcc.

The input unit 122 is connected with the control unit 130, the drive unit 40, and the communication line. The input unit 122 in this example is connected with the input terminal 105. The input unit 122 is supplied with the input signal Sin and the output voltage Vout. The input unit 122 is connected to the power source terminal 103 of the power source voltage Vcc. This allows the input unit 122 to convert a high level VH of a signal inputted from the input terminal 105 into the power source voltage Vcc, to be outputted to the control unit 130. Note that the input unit 122 may be connected with the output terminal 106.

While the embodiments of the present invention have been described, the technical scope of the invention is not limited to the above described embodiments. It is apparent to persons skilled in the art that various alterations and improvements can be added to the above-described embodiments. It is also apparent from the scope of the claims that the embodiments added with such alterations or improvements can be included in the technical scope of the invention.

The operations, procedures, steps, and stages of each process performed by an apparatus, system, program, and method shown in the claims, embodiments, or diagrams can be performed in any order as long as the order is not indicated by "prior to," "before," or the like and as long as the output from a previous process is not used in a later process. Even if the process flow is described using phrases such as "first" or "next" in the claims, embodiments, or diagrams, it does not necessarily mean that the process must be performed in this order.

EXPLANATION OF REFERENCES

10: voltage input unit, 11: step-down element, 12: transistor, 13: current source, 14: capacitor, 15: capacitor, 20: reference voltage generation unit, 21: step-down element, 22: capacitor, 23: current source, 24: transistor, 30: voltage regulation unit, 40: drive unit, 41: step-down element, 42: current source, 100: device, 101: clock terminal, 102: data terminal, 103: power source terminal, 104: power source terminal, 105: input terminal, 106: output terminal, 110: internal power source generation unit, 120: input/output unit, 122: input unit, 124: output unit, 125: high-side driver, 126: low-side driver, 130: control unit, 310: step-up unit, 311: capacitor, 312: capacitor, 320: compensation voltage generation unit, 321: step-down element, 322: current source, 323: capacitor, 324: capacitor, 325: capacitor, 326: transistor, 327: current source, 330: compensation unit, 331: capacitor, 400: interface, 410: management device, 420: power source unit, 432: clock signal line, 434: data signal line, 442: resistor, 444: resistor, 500: system

What is claimed is:

1. A device connected to a clock signal line and a data signal line, comprising:

a voltage input unit configured to be inputted with a clock signal as an input signal from the clock signal line and to generate first reference voltage corresponding to a high level of the clock signal;

a reference voltage generation unit configured to be inputted with predetermined input voltage and to generate second reference voltage;

a voltage regulation unit for generating regulation voltage by using the second reference voltage to convert a level of the first reference voltage;

a drive unit for stepping down the regulation voltage to generate output voltage;

a control unit; and an output unit connected with the control unit, the drive unit, and the data signal line, for outputting the output voltage to the data signal line in response to input of a high level of a control signal from the control unit, wherein the voltage input unit is configured to step down voltage at a level corresponding to the high level by a predetermined magnitude to generate the first reference voltage.

2. The device according to claim 1, wherein the reference voltage generation unit includes a step-down element for stepping down the input voltage by a predetermined magnitude.

3. The device according to claim 2, wherein a voltage drop in the step-down element is equal to a voltage drop in the drive unit.

4. The device according to claim 1, wherein the voltage input unit is configured to sample-and-hold the high level to generate the first reference voltage.

5. The device according to claim 1, wherein the voltage regulation unit includes a step-up unit for using the second reference voltage to step up voltage by a magnitude of a voltage drop in the drive unit.

6. The device according to claim 1, wherein the voltage regulation unit includes a step-up unit for using the second reference voltage to step up voltage by a magnitude obtained by adding a magnitude of a voltage drop in the drive unit to a magnitude of a voltage drop in the voltage input unit.

7. The device according to claim 1, wherein the input voltage of the reference voltage generation unit is power source voltage of the device.

8. The device according to claim 1, wherein the input voltage of the reference voltage generation unit is the high level.

9. The device according to claim 1, wherein the voltage regulation unit includes:

a compensation voltage generation unit for generating compensation voltage corresponding to difference between a target level that is a level corresponding to a high level of the input signal, and the output voltage; and a compensation unit for using the compensation voltage to convert a level of the regulation voltage.

10. The device according to claim 9, wherein the compensation voltage generation unit is configured to generate the compensation voltage based on difference between a voltage drop in the voltage input unit and a voltage drop in the reference voltage generation unit.

11. The device according to claim 9, wherein the compensation voltage generation unit is configured to generate the compensation voltage based on difference between the regulation voltage and the target level or difference between the output voltage and the target level.

12. The device according to claim 1, further comprising:

a power source of the control unit; and an input unit connected with the control unit, the drive unit, the clock signal line, and the data signal line, for converting a high level of a signal inputted from the clock signal line or the data signal line into voltage of the power source, to be outputted to the control unit.

13. The device according to claim 1, wherein the voltage input unit is connected to the clock signal line.

14. A system comprising:

an interface including a clock signal line and a data signal line; and the device according to claim 1, connected to the interface.

15. A device connected to a clock signal line and a data signal line, comprising:

a voltage input unit configured to be inputted with a clock signal as an input signal from the clock signal line and to generate first reference voltage corresponding to a high level of the clock signal;

a reference voltage generation unit configured to be inputted with predetermined input voltage and to generate second reference voltage;

a voltage regulation unit for generating regulation voltage by using the second reference voltage to convert a level of the first reference voltage;

a drive unit for stepping down the regulation voltage to generate output voltage;

a control unit; and an output unit connected with the control unit, the drive unit, and the data signal line, for outputting the output voltage to the data signal line in response to input of a high level of a control signal from the control unit, wherein the voltage input unit is configured to sample-and-hold the high level to generate the first reference voltage.

* * * * *